United States Patent [19]

Lent

[11] Patent Number: 4,809,364

[45] Date of Patent: Mar. 7, 1989

[54] TRUNK RESTRAINT FREE WET SUIT

[75] Inventor: Jon Lent, Redondo Beach, Calif.

[73] Assignee: Dive N' Surf, Hermosa Beach, Calif.

[21] Appl. No.: 96,335

[22] Filed: Sep. 14, 1987

[51] Int. Cl.[4] ..... B63C 11/04

[52] U.S. Cl. ..... 2/2.1 R

[58] Field of Search ..... 2/2.1 R, 2.1 A, 82, 2/81, 91; 441/87, 102, 106, 128

[56] References Cited

U.S. PATENT DOCUMENTS

| | | | |
|---|---|---|---|
| D. 202,976 | 11/1965 | O'Neill | 2/2.1 R X |
| 1,706,097 | 2/1929 | Aud | 2/2.1 R X |
| 2,582,811 | 1/1952 | Williams | 2/82 X |
| 3,493,972 | 2/1970 | Oldham | 2/2.1 R |
| 3,763,498 | 10/1973 | Rector | 2/2.1 R |

FOREIGN PATENT DOCUMENTS

| | | | |
|---|---|---|---|
| 1473129 | 2/1967 | France | 2/2.1 R |

*Primary Examiner*—H. Hampton Hunter

*Attorney, Agent, or Firm*—William W. Haefliger

[57] ABSTRACT

In a wet suit having a lower trunk portion, leg portions integral with said lower trunk portion, upper trunk and neck portions, and first and second arm portions integral with said upper trunk and neck portions, the improvement comprising:

(a) said upper trunk and neck portions including a first section integral with the first arm portion and a second section integral with the second arm portion, the first section defining an opening to pass the second arm portion therethrough, the sections being relatively separable to provide access to space enabling user body entry relatively downwardly into the wet suit, (b) one section overlapping the other section when the suit is worn by the user to seal off between the sections.

16 Claims, 2 Drawing Sheets

TRUNK RESTRAINT FREE WET SUIT

BACKGROUND OF THE INVENTION

This invention relates generally to wet suits as used by surfers, boardsailers, divers and swimmers and other aquatic sports; and more particularly it concerns such a suit the trunk of which is free of constraint as is normally imposed by a zipper or other connector.

Contemporary wet suits are constructed to have a vertical zipper at the suit back, to enable the wearer to easily step into or out of the suit when the zipper is down, i.e. unzipped; however, such zippers are not stretchable, and they impose undesired constraint when the wearer tries to bend over, forwardly, thus, the stretchable feature of such suits is defeated during such bending. There is need for a wet suit which overcomes this problem or difficulty, and which enables the wearer to freely move and bend, in all directions and which is of simple, unitary construction.

SUMMARY OF THE INVENTION

It is a major object of the invention to provide an improved "zipperless" wet suit, which meets the above need, and is of simple, unitary construction. Basically, the wet suit of the invention has a lower trunk portion, leg portions integral with the lower trunk portion, upper trunk and neck portions, and first and second arm portions integral with the upper trunk and neck portions; further it lies in constructing the suit so that:

(a) said upper trunk and neck portions including a first section integral with the first arm portion and a second section integral with the second arm portion, the first section defining an opening to pass the second arm portion therethrough, the sections being relatively separable to provide access to a space enabling user body entry relatively downwardly in the wet suit, (b) one section overlapping the other section when the suit is worn by the user to seal off between the sections.

As will appear, the neck portion defines a neck opening and is integral with one of said first and second sections; and the neck portion is typically annularly continuous, whereby no zipper is required to close the neck portion about the user's neck. Further, the lower trunk portion is also annularly continuous, whereby no zipper is required to close it. The trunk portions typically consist of stretchable insulative material, such as elastomer foam.

Further, a stretchable band or adjustable strap such as includes VELCRO typically extends across the entry space and is stretchable to allow such body entry into the suit, the band connects front and rear uppermost extents of the second section, the band concealed by said sections when the suit is worn by the user. That band typically fits over a shoulder of the wearer to hold the second trunk section in up position, since that second section is normally "shoulderless."

In putting on the wet suit, the user separates the two sections and steps into the suit at its top, past the stretchable band or adjustable strap. He then lifts the latter over his shoulder associated with the first arm portion, and he insert his arms through the arm portion, taking with care so that the second arm portion of the suit is inserted through the opening provided by the first section of the upper trunk portion of the suit. He then slips his head through the neck opening. All of these structures are stretchable, so that the task of entering and leaving the suit is minimized, and a very good protective fit of the suit to the wearer is achieved.

These and other objects and advantages of the invention, as well as the details of an illustrative embodiment, will be more fully understood from the following specification and drawings, in which:

DRAWING DESCRIPTION

DETAILED DESCRIPTION

Figure 1:
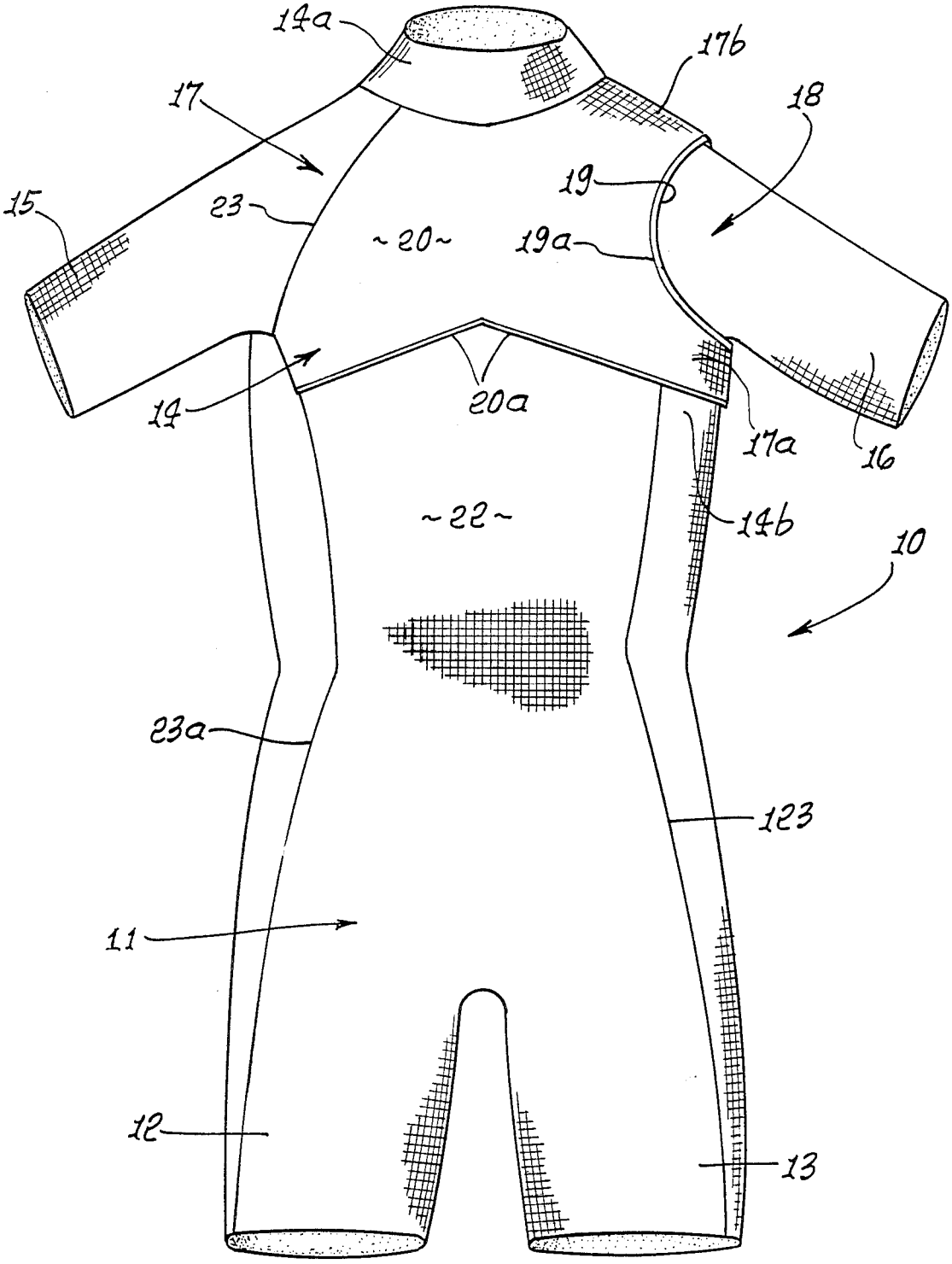
FIG. 1 is a front elevation showing a wet suit incorporating the invention.

In the drawings, the wet suit 10 has a close fitting lower trunk portion 11, leg portions 12 and 13 integral with the lower trunk portion and protruding downwardly to grip the user's legs, and upper trunk portion 14 and neck portion 14*a*, and first and second arm gripping arm portions 15 and 16 integral with the upper trunk portion. The wet suit typically consists of flexible, heat insulative material such as elastomer foam, one example being Neoprene foam.

The upper trunk portion 14, in accordance with the invention, includes a first section, as at 17 integral with the first arm portion, and a second section, as at 18, integral with the second arm portion 16. The first section defines a side opening 19 to pass the second arm portion therethrough to the portion seen in FIG. 1, upon assembly of the sections 17 and 18 to the wearer's upper torso and arms. Opening 19 bordered at 19*a* is defined by a stretchable band 17*a* integral with section 17 and looping beneath the arm portion 16, close to the wall 14*b* of the upper trunk portion, and by the over the shoulder extent 17*b* of the section 17. Band 17*a* is typically stretchable to allow reception of the arm portion 16 through opening 19, as the suit is put on or taken off the wearer. Section 17 has an outer front panel 20 with a lower border at 20*a* and is free of the inner front panel 21 of the section 18, panel 20 overlapping panel 21, and the latter continues downwardly integrally with the front panel 22 of the suit. Panel 21 terminates at free side edge 21*a* and upper edge 21*b*, both concealed by the panel 20 upon full assembly. A seam 23 connects panel 20 with arm portion 15, and that seam extends downwardly at 23*a* toward leg portion 12. Such may be in different locations, or omitted. The rear of the suit has the same construction as described above with respect to the suit front. See opposite seam 123.

Figure 3:
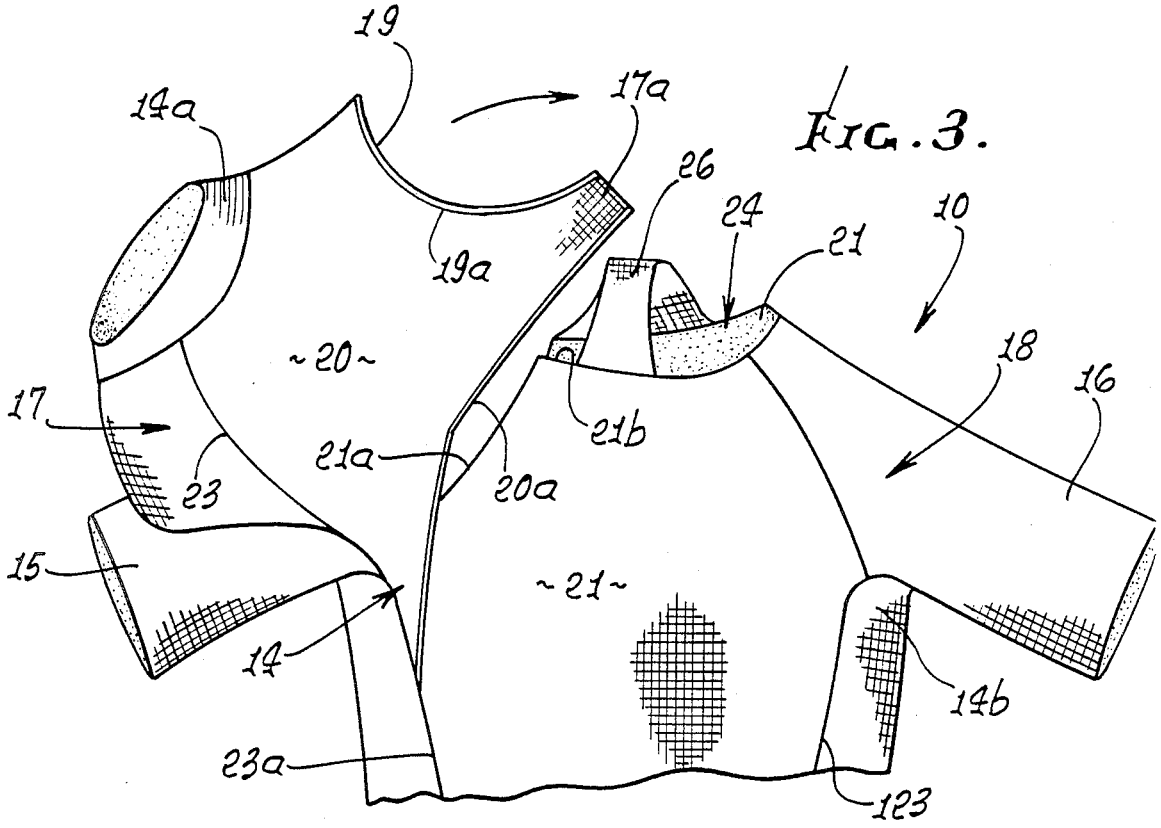
FIG. 3 is a fragmentary front elevation showing further details.

The sections are relatively separable as seen in FIG. 3, to provide access to space enabling user body entry relatively downwardly into the wet suit. Thus, for example, the section 17 is lifted and moved to the left relative to the section 18, arm portion 16 being withdrawn from and through opening 19, to provide such access to space 24 located between front and rear panels 21 of section 18.

The free uppermost extents of the panels 21 proximate edges 21*a* and 21*b* are interconnected by a band 26 which loops upwardly to extend over the user's shoulder associated with arm portion 15. In this way, the concealed panels 21 are held up close to the user's chest and upper back, and supported by band 26 or adjustable strap. The latter is stretchable to enable enlargement of space 24 as the user enters or exits the suit; and the band may consist of lightweight fabric, such as "LYCRA SPANDEX", for example, or an adjustable strap such as VELCRO section.

It will be noted that the neck portion 14*a* is annularly continuous and is stretchable to allow entry and passage of the user's head as the section 17 is assembled to the user, from FIG. 3 to FIG. 1 condition.

Figure 2:
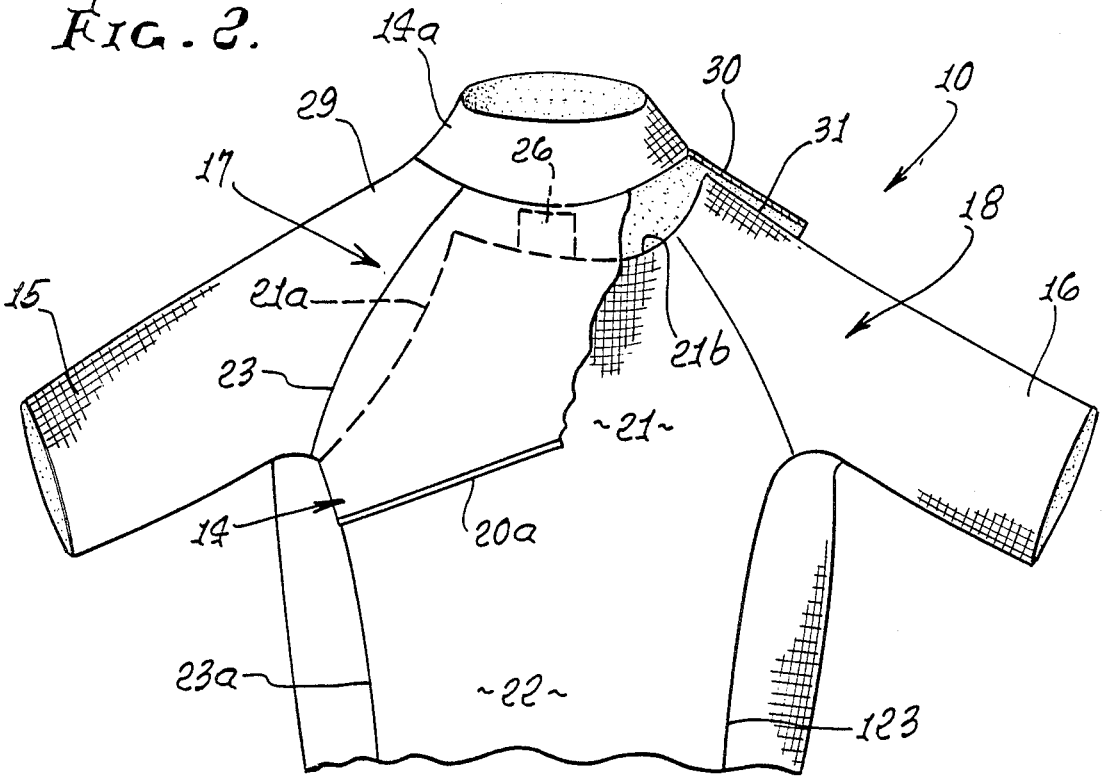
FIG. 2 is a fragmentary front elevation showing the top of the wet suit, broken away to show interior construction.

Also, the lower trunk portion is annularly continuous about the body of the wearer. Thus, the suit is "zipperless", and allows stretching in all directions, including vertically at the back, allowing free forward bending of the wearer. Overlap of the sections 17 and 18 effects sealing off and tight fits, to minimize body heat loss from the interior of the suit to the exterior. Opening 24 is completely covered by the neck portion 14*a* and shoulder portion 30 of outer section 17; thus, section 17 defines both outer shoulder portions 29 and 30, whereas section 18 defines only one shoulder portion 31, concealed by shoulder portion 30 (see FIG. 2).

I claim:

1. In a wet suit having a lower trunk portion, leg portions integral with said lower trunk portion, upper trunk and neck portions, and first and second arm portions integral with said upper trunk and neck portions, the improvement comprising:

(a) said upper trunk and neck portions including a first section integral with the first arm portion and a second section integral with the second arm portion, the first section defining an opening to pass the second arm portion therethrough, the sections being relatively separable to displace said first section relatively away from the second arm portion to provide access to space associated with the second section enabling user body entry relatively downwardly into the wet suit, (b) said first section thereafter being returnable relatively toward the second arm portion so that one section overlaps the other section when the suit is worn by the user to seal off between the sections.

2. The wet suit of claim 1 wherein the neck portion defines a neck opening and is integral with one of said first and second sections.

3. The wet suit of claim 1 including a band extending across said space and connecting front and rear uppermost extents of the second section, the band concealed by said sections when the suit is worn by the user.

4. The wet suit of claim 3 wherein the band is stretchable and is adapted to fit over the shoulder of the wearer.

5. The wet suit of claim 1 wherein the lower trunk portion is continuous, about an internal zone to be occupied by the lower trunk of the user.

6. The wet suit of claim 1 wherein the trunk of the suit is zipperless, and consists of stretchable, insulative material.

7. The wet suit of claim 5 wherein the wet suit consists of stretchable elastomeric material.

8. The wet suit of claim 3 wherein the band is exposed when the second arm section is withdrawn through said opening and the sections are relatively separated.

9. The wet suit of claim 2 wherein said neck portion is annularly continuous.

10. In a wet suit having a lower trunk portion, leg portions integral with said lower trunk portion, upper trunk and neck portions, and first and second arm portions integral with said upper trunk and neck portions, the improvement comprising:

(a) said upper trunk and neck portions including a first section integral with the first arm portion and a second section integral with the second arm portion, the first section defining an opening to pass the second arm therethrough, the sections being relatively separable to displace said first section relatively away from the second arm portion to provide access to space associated with the second section enabling user body entry relatively downwardly into the wet suit, (b) said first section thereafter being returnable relatively toward the second arm portion so that one section overlaps the other section when the suit is worn by the user to seal off between the sections, (c) and including a band extending across said space and connecting front and rear uppermost extents of the second section, the band concealed by said sections when the suit is worn by the user.

11. The wet suit of claim 10 wherein the band is stretchable and is adapted to fit over the shoulder of the wearer.

12. The wet suit of claim 5 wherein the lower trunk portion is continuous, about an internal zone to be occupied by the lower trunk of the user.

13. The wet suit of claim 10 wherein the band is exposed when the second arm section is withdrawn through said opening and the sections are relatively separated.

14. The wet suit of claim 12 wherein said neck portion is annularly continuous.

15. The wet suit of claim 10 wherein the wet suit consists of stretchable insulative material.

16. The wet suit of claim 15 wherein said material is elastomeric.

* * * * *